US008531122B2

(12) United States Patent
Braun et al.

(10) Patent No.: US 8,531,122 B2
(45) Date of Patent: Sep. 10, 2013

(54) CIRCUIT ARRANGEMENT AND METHOD FOR OPERATION OF A DISCHARGE LAMP

(75) Inventors: Alois Braun, Neuburg (DE); Walter Limmer, Munich (DE); Maximilian Schmidl, Pullach (DE)

(73) Assignee: OSRAM Gesellschaft mit beschraenkter Haftung, Munich (DE)

( * ) Notice: Subject to any disclaimer, the term of this patent is extended or adjusted under 35 U.S.C. 154(b) by 142 days.

(21) Appl. No.: 13/119,204

(22) PCT Filed: Sep. 17, 2008

(86) PCT No.: PCT/EP2008/062358

§ 371 (c)(1),
(2), (4) Date: Mar. 16, 2011

(87) PCT Pub. No.: WO2010/031430

PCT Pub. Date: Mar. 25, 2010

(65) Prior Publication Data

US 2011/0169427 A1 Jul. 14, 2011

(51) Int. Cl.
*H05B 41/36* (2006.01)

(52) U.S. Cl.
USPC ..... 315/224; 315/291; 315/225

(58) Field of Classification Search
USPC ..... 315/224, 291, 307, 312, 209 R, 225, 315/219
See application file for complete search history.

(56) References Cited

U.S. PATENT DOCUMENTS

| | | | | |
|---|---|---|---|---|
| 6,020,691 | A * | 2/2000 | Sun et al. | 315/307 |
| 6,741,040 | B2 | 5/2004 | Weirich | |
| 7,064,499 | B2 * | 6/2006 | Lott | 315/291 |
| 7,397,196 | B2 * | 7/2008 | Leyten et al. | 315/224 |
| 8,053,999 | B2 * | 11/2011 | Smethurst | 315/225 |
| 2005/0007036 | A1 | 1/2005 | Samejima et al. | |
| 2005/0062432 | A1 | 3/2005 | Van Casteren | |

FOREIGN PATENT DOCUMENTS

| | | | |
|---|---|---|---|
| CN | 1615674 | A | 5/2005 |
| DE | 102005045569 | A1 | 12/2006 |
| EP | 1339268 | A2 | 8/2003 |

OTHER PUBLICATIONS

International Search Report of PCT/EP2008/062358, Date of mailing: Nov. 16, 2009.
English language abstract of DE 10 2005 045 569 A1, Dec. 7, 2006.

* cited by examiner

*Primary Examiner* — Daniel D Chang

(57) ABSTRACT

In various embodiments, a circuit arrangement may include a voltage-measuring device embodied to measure an output voltage, wherein the voltage-measuring device is embodied to provide at its output a signal which is correlated with the measured output voltage, wherein the voltage-measuring device is coupled to a control device for the purpose of transmitting said signal to the control device, and wherein the control device is embodied to vary an off-time as a function of the measured output voltage.

12 Claims, 2 Drawing Sheets

CIRCUIT ARRANGEMENT AND METHOD FOR OPERATION OF A DISCHARGE LAMP

RELATED APPLICATIONS

The present application is a national stage entry according to 35 U.S.C. §371 of PCT application No.: PCT/EP2008/062358 filed on Sep. 17, 2008.

TECHNICAL FIELD

Various embodiments relate to a circuit arrangement for operating a discharge lamp, the circuit arrangement including an input having a first input terminal and a second input terminal for connecting a supply voltage, a first electronic switch which has a control electrode, a working electrode and a reference electrode, the working electrode being coupled to the first input terminal, a first diode whose anode is coupled to the second input terminal and whose cathode is coupled to the reference electrode of the first electronic switch while forming a first junction point, a control device which is coupled to the control electrode of the first electronic switch for the purpose of driving the latter, an output having a first and a second output terminal for providing an output voltage to the discharge lamp, an inductor arranged in series with one of the output terminals, a lamp inductor which is coupled between the first junction point and the first output terminal, and a first capacitor which is coupled between the first output terminal and the anode of the first diode, wherein the control device is embodied to switch the first electronic switch continuously to conducting for an on-time and to non-conducting for an off-time. Various embodiments relate in addition to a corresponding method for operating a discharge lamp.

BACKGROUND

A circuit arrangement of this kind is known from the prior art. It is constituted essentially in the form of a buck converter with downstream-connected ignition or firing device for the discharge lamp, wherein the cited inductor represents the ignition inductor. In practice it has now been recognized that discharge lamps that are operated on such a circuit arrangement sometimes go out. As a result of the introduction of additional ohmic resistors into the output circuit, i.e. in series with the discharge lamp, it was possible to a large extent to prevent the extinction. However, this solution is undesirable with regard to the resulting power dissipation.

SUMMARY

Various embodiments develop a circuit arrangement and method of the kind cited in the introduction in such a way that an extinction of the discharge lamp is reliably prevented with little power dissipation.

The present invention is based on the knowledge that oscillations can occur in the output circuit as a function of the ignition inductor and the first capacitor. At low lamp impedances they are attenuated only to a limited degree and can interfere with the operation of the lamp because the lamp current oscillates. In the conventional further wiring of a generic circuit arrangement known from the prior art, a measurement of the output current is provided, the output current being regulated peak-to-peak at a fixed frequency by corresponding activation of the first electronic switch. If an oscillation now occurs in the output circuit, this can result in make cycles being omitted completely and the effective control frequency approaching the resonance frequency which is essentially determined by the ignition inductor and the first capacitor. The control circuit therefore becomes "involved in the oscillation". In this case the current can even oscillate into the negative range and thereby cause extinction of the lamp.

The approach known from the prior art of inserting ohmic resistors into the output circuit inadvertently served to attenuate the oscillation, but led to undesirably high power dissipation.

On the basis of these findings the present invention eliminates the above-cited problem in that the circuit arrangement is not operated almost at a fixed frequency in continuous mode, but instead the off-time of the first electronic switch is varied. The distance from the cited resonance frequency is determined by measuring the output voltage and a sufficient distance from said resonance frequency is established by varying the off-time. By this means an "involvement" of the control circuit in the oscillation is reliably avoided. As a result thereof an extinction of the discharge lamp can be reliably avoided even without use of additional ohmic resistors for attenuating the output circuit.

The control device may be embodied to vary the off-time in proportion, in particular directly or indirectly in proportion, to the output voltage. The control device may be embodied in particular to shorten the off-time if there is an increase in the output voltage and vice versa. If $T_{on}$ represents the on-time, $T_{off}$ the off-time, $L_Z$ the inductor arranged in series with one of the output terminals, and $C_1$ the capacitance of the first capacitor, then the control device is embodied in particular to vary the off-time in such a way that the following applies:

$$\frac{1}{T_{on}+T_{off}} \neq \frac{1}{2\pi\sqrt{L_{C_2}}}$$

By varying the off-time the control device particularly preferably avoids a range of 20 percent below to 20 percent above the resonance frequency, with the result that the following applies:

$$\frac{1}{T_{on}+T_{off}} \neq 0.8 \text{ to } 1.2 * \frac{1}{2\pi\sqrt{L_{C_2}}}$$

In order to ensure that harmonics of the resonance frequency are also avoided, the following also applies:

$$\frac{1}{n*(T_{on}+T_{off})} \neq \frac{1}{2\pi\sqrt{L_Z C_1}};$$

where n=1, 2, 3, . . .

In this connection it is in turn particularly preferred if a range of 20 percent below to 20 percent above the respective frequency is avoided, such that the following applies:

$$\frac{1}{n*(T_{on}+T_{off})} \neq 0.8 \text{ to } 1.2 * \frac{1}{2\pi\sqrt{L_Z C_1}};$$

where n=1, 2, 3, . . .

In particular when the impedance of the discharge lamp that is to be connected at the output is not to be ignored, the detuning of the oscillating circuit consisting of the first capacitor and the inductor due to the impedance of the discharge lamp that is to be connected at the output should be taken into account in the respective above-cited formula. In this way particularly precise values can be determined for the frequencies that are to be avoided and taken into account in the control function handled by means of the control device.

A circuit arrangement according to the invention preferably includes in addition a current-measuring resistor which is coupled between the anode of the first diode and the second input terminal for the purpose of measuring the current through the first electronic switch in the conducting state of the latter, the control device being coupled to the current-measuring resistor and being embodied to vary the on-time for the purpose of regulating the current to a predefinable value. In this case the on-time is regulated in particular so that the average current remains constant in spite of the different off-times.

The aforementioned embodiment variants of a circuit arrangement according to the invention relate in particular to implementations having a single electronic switch. However, the concept underlying the present invention can also be applied in particular to a full-bridge topology. In this respect a preferred development of a circuit arrangement according to the invention also includes a second, third and fourth electronic switch, the first, second, third and fourth electronic switch representing a full-bridge, the first junction point representing a first bridge center point, the circuit arrangement additionally including a second diode coupled in parallel with the first electronic switch, the second electronic switch being coupled in parallel with the first diode, the third and fourth electronic switch being coupled to each other while forming a second junction point representing a second bridge center point, the second bridge center point representing the second output terminal, the control device being embodied according to the invention to drive the first, second, third and fourth electronic switch. In this case the control device is preferably embodied to switch the third electronic switch to conducting and the fourth electronic switch and the first electronic switch to non-conducting in a first phase, and to switch the fourth electronic switch to conducting and the third electronic switch and the second electronic switch to non-conducting in a second phase, the first and the second phase continuously alternating at a first predefinable frequency lying in particular in the low-frequency range, the control device furthermore being embodied to switch the second electronic switch to conducting and non-conducting in alternation in the first phase and the first electronic switch to conducting and non-conducting in alternation in the second phase at a second predefinable frequency lying in particular in the high-frequency range, and in so doing to vary the off-time as a function of the measured output voltage.

A freewheeling diode is preferably connected in parallel with the third and fourth electronic switch in each case.

In addition the circuit arrangement preferably includes a second capacitor which is coupled between the first input terminal and the first output terminal. In this case the total capacitance from first and second capacitor should be applied in the above equations instead of the capacitance of the first capacitor.

Further preferred embodiment variants will become apparent from the dependent claims.

The preferred embodiment variants presented with reference to a circuit arrangement according to the invention and their advantages pertain analogously, insofar as they are applicable, to the method according to the invention.

BRIEF DESCRIPTION OF THE DRAWING(S)

In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawings, in which.

DETAILED DESCRIPTION

The following detailed description refers to the accompanying drawings that show, by way of illustration, specific details and embodiments in which the invention may be practiced.

Figure 1:
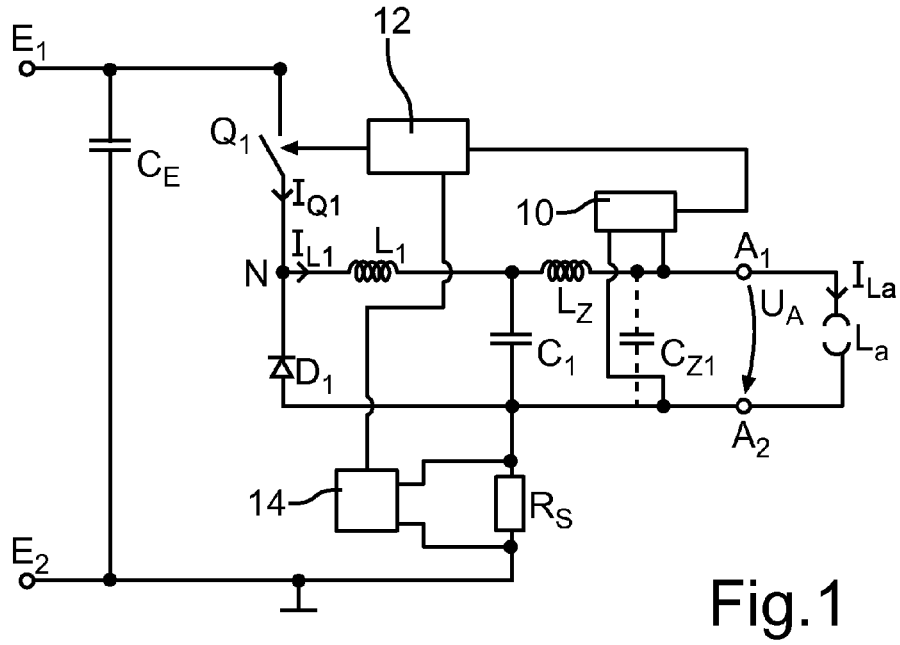
FIG. 1 is a schematic diagram illustrating a first exemplary embodiment of a circuit arrangement according to the invention having a single electronic switch.

FIG. 1 is a schematic diagram illustrating a first exemplary embodiment of a circuit arrangement according to the invention. This includes an input having a first input terminal $E_1$ and a second input terminal $E_2$ to which a supply voltage can be connected. Arranged between the inputs is an optional capacitor $C_E$ which serves to stabilize the input voltage. The circuit arrangement includes a first electronic switch $Q_1$ having a control electrode, a working electrode and a reference electrode. The working electrode is coupled to the first input terminal $E_1$. Also present is a diode $D_1$ whose cathode is coupled to the reference electrode of the electronic switch $Q_1$ while forming a junction point N. The circuit arrangement also includes an output having a first output terminal $A_1$ and a second output terminal $A_2$ at which an output voltage $U_A$ is provided to a discharge lamp La. Arranged between the junction point N and the first output terminal $A_1$ is the series connection consisting of a lamp inductor $L_1$ and an ignition inductor $L_Z$. The junction point between the lamp inductor $L_1$ and the ignition inductor $L_Z$ is coupled to the second output terminal $A_2$ via a capacitor $C_1$. The anode of the diode $D_1$ is likewise coupled to the output terminal $A_2$.

A voltage-measuring device 10 is provided for the purpose of measuring the output voltage $U_A$. A variable that is correlated with the measured output voltage $U_A$ is coupled to a control device 12 which is coupled to the control electrode of the electronic switch $Q_1$ in order to drive the latter. In addition the control device 12 is coupled to a current-measuring device 14 which measures the voltage via a current-measuring resistor $R_S$ which is coupled between the anode of the diode $D_1$ and the second input terminal $E_2$ and provides said voltage to the control device 12. An ignition capacitor $C_{Z1}$ is indicated in the drawing by a dashed line. According to the invention the control device 12 is embodied to vary the off-time of the switch $Q_1$ as a function of the measured output voltage $U_A$. The off-time is varied in particular in such a way that the frequency at which the switch $Q_1$ is driven is different from a resonance frequency and its multiples, which are essentially defined by the ignition inductor $L_Z$ and the first capacitor $C_1$. The current flowing through the lamp inductor $L_1$ is designated by $I_{L1}$, the current flowing through the lamp La by $I_{La}$, and the current flowing through the switch $Q_1$ by $I_{Q1}$.

Figure 2:
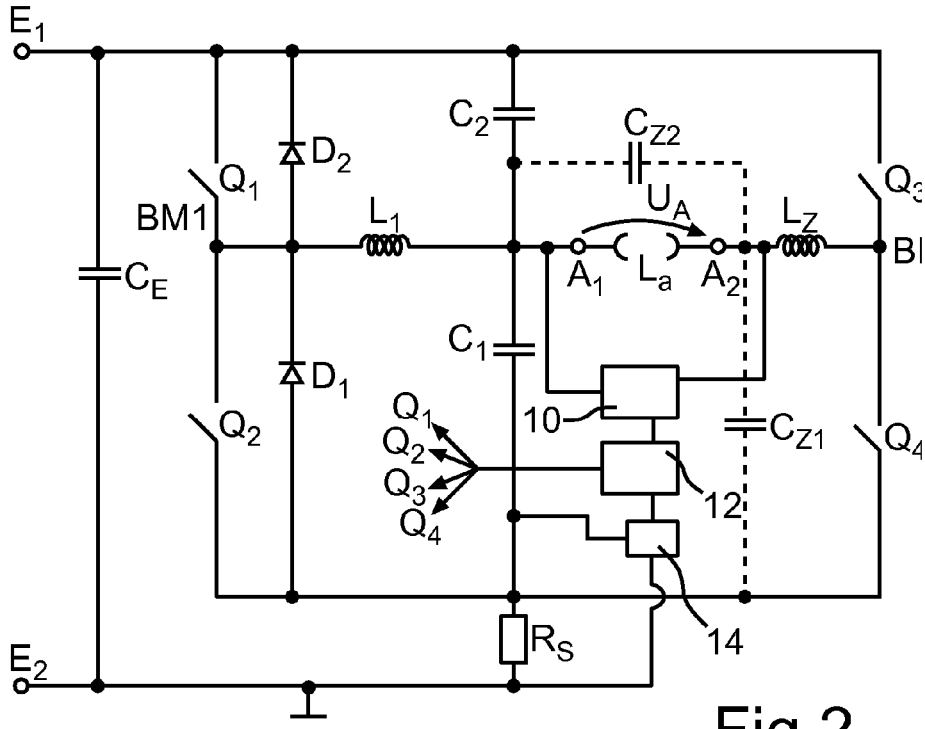
FIG. 2 is a schematic diagram illustrating a second exemplary embodiment of a circuit arrangement according to the invention having a full-bridge topology.

FIG. 2 is a schematic diagram illustrating a second exemplary embodiment of a circuit arrangement according to the invention, wherein the circuit arrangement now has a full-bridge topology. Reference signs introduced in connection with FIG. 1 continue to apply to like and like-acting components of FIG. 2 and therefore do not need to be reintroduced here.

This circuit arrangement additionally includes a second switch $Q_2$, a third switch $Q_3$ and a fourth switch $Q_4$. A second diode $D_2$ is connected in parallel with the switch $Q_1$. A second capacitor $C_2$ is coupled between the first input terminal $E_1$ and the first output terminal $A_1$. A first bridge center point BM1 is formed between the first switch $Q_1$ and the second switch $Q_2$, and a second bridge center point BM2 is formed between the third switch $Q_3$ and the fourth switch $Q_4$. In the present arrangement the ignition inductor $L_Z$ is disposed between the second output terminal $A_2$ and the second bridge center point BM2. Also indicated in the drawing is a further optional ignition capacitor $C_{Z2}$ which can be provided as an alternative or in addition to the ignition capacitor $C_{Z1}$. This can be coupled in parallel with the two output terminals $A_1$, $A_2$.

The operation of the circuit arrangement according to FIG. 2 is realized by corresponding activation of the switches $Q_1$ to $Q_4$ by the control device 12. To that end the control device 12 drives the switch $Q_4$ as conducting and the switches $Q_3$ and $Q_2$ as non-conducting in a first phase. In a second phase the switch $Q_3$ is switched to conducting, and the switches $Q_4$ and $Q_1$ are switched to non-conducting. The first and second phase alternate continuously at a first predefinable frequency lying in particular in the low-frequency range. In the first phase the switch $Q_1$ and in the second phase the switch $Q_2$ are switched to conducting and non-conducting in alternation at a second predefinable frequency lying in particular in the high-frequency range. In this case the off-time is varied as a function of the measured output voltage $U_A$ in such a way that the control frequency is different from the resonance frequency, which is essentially defined by the capacitors $C_1$, $C_2$ and the ignition inductor $L_Z$, and its multiples.

Figure 3:
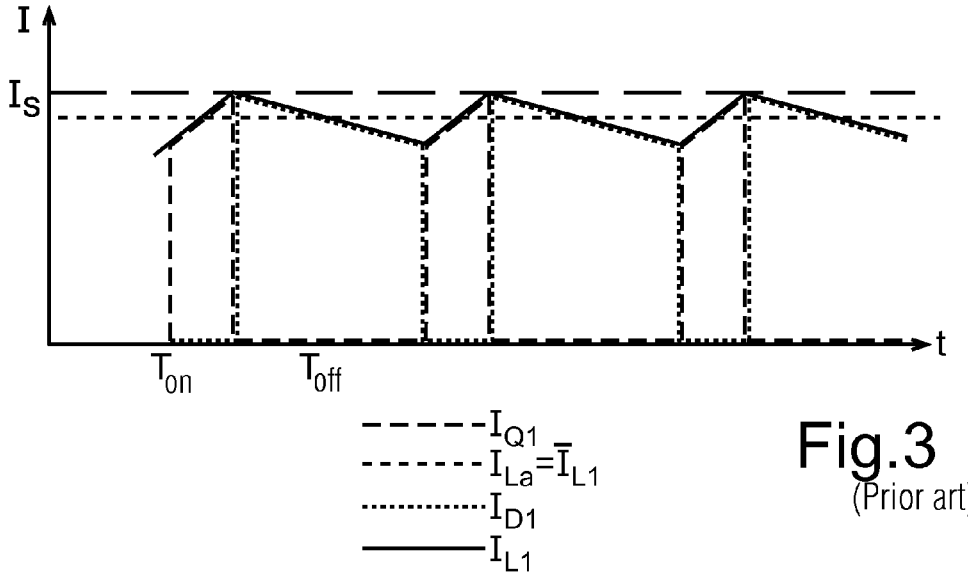
Fig.3 (Prior art)
FIG. 3 shows the variation with time of various currents in a peak-to-peak regulation according to the prior art.
Figure 4:
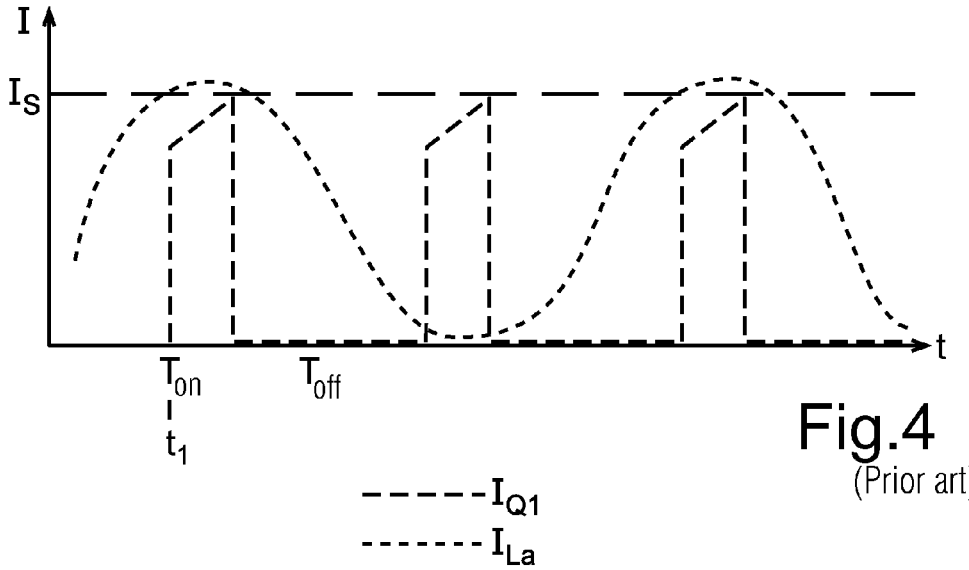
Fig.4 (Prior art)
FIG. 4 shows the variation with time of corresponding variables in the case of resonance according to the prior art.

FIGS. 3 and 4 illustrate once again the considerations and findings on which this present invention is based. In respect of the basic topology shown in FIG. 2, FIG. 3 shows—albeit without inventive controller—the variation with time of various currents in the case of a peak-to-peak regulation of the current $I_{Q1}$ through the switch $Q_1$. A cut-off current threshold $I_S$ is represented in the diagram. As soon as the current through the switch reaches said current value $I_S$, the switch $I_{Q1}$ is switched to the non-conducting state. The on-time equals $T_{on}$ and leads to an increase in the current $I_{L1}$ through the lamp inductor $L_1$. After the switch $Q_1$ is turned off, i.e. in the demagnetization phase of the lamp inductor $L_1$, the current through the lamp inductor $I_{L1}$ decreases continuously, see $T_{off}$. Also included in the drawing is the current $I_{D1}$ in the freewheeling phase, i.e. with switch $Q_1$ open. Finally, the current $I_{La}$ provided to the discharge lamp La is entered, said current corresponding to the average current $I_{L1transverse}$ through the lamp inductor $L_1$.

FIG. 4 shows the situation in the event of an oscillation occurring in the output circuit, i.e. an oscillation of the output current $I_{La}$. If an oscillation occurs in the output circuit, the current through the current-measuring resistor $R_S$ receives an "offset" at the maximum of the oscillation, i.e. the turn-off time instant is reached earlier and initially the on-time $T_{on}$ decreases. At the minimum of the oscillation the on-time $T_{on}$ remains as before, i.e. more energy is coupled in at the minimum than at the maximum. In particular, energy is coupled in at the natural frequency of the oscillating circuit consisting of ignition inductor $L_Z$ and capacitor $C_1$, $C_2$. Subsequently the circuit oscillates up, and the offset at the maximum increases until it is so high that at the turn-on time instant—see $t_1$ in FIG. 4—of the switch $Q_1$ the cut-off threshold is already reached. As a result the switch $Q_1$ no longer switches on. All of the energy is coupled in at the minimum and the circuit is excited at its resonance frequency. In other words: The control circuit "becomes involved in the oscillation".

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

The invention claimed is:

1. A circuit arrangement for operating a discharge lamp, the circuit arrangement comprising:

an input having a first input terminal and a second input terminal for connecting a supply voltage;

a first electronic switch which has a control electrode, a working electrode and a reference electrode, wherein the working electrode is coupled to the first input terminal;

a first diode whose anode is coupled to the second input terminal and whose cathode is coupled to the reference electrode of the first electronic switch while forming a first junction point;

a control device which is coupled to the control electrode of the first electronic switch for the purpose of driving the first electronic switch;

an output having a first output terminal and a second output terminal for providing an output voltage to the discharge lamp;

an inductor which is arranged in series with one of the output terminals;

a lamp inductor which is coupled between the first junction point and the first output terminal; and a first capacitor which is coupled between the first output terminal and the anode of the first diode;

wherein the control device is embodied to switch the first electronic switch continuously to conducting for an on-time and to non-conducting for an off-time;

wherein the circuit arrangement further comprises a voltage-measuring device embodied to measure the output voltage, wherein the voltage-measuring device is embodied to provide at its output a signal which is correlated with the measured output voltage, wherein the voltage-measuring device is coupled to the control device for the purpose of transmitting said signal to the control device, and wherein the control device is embodied to vary the off-time as a function of the measured output voltage, wherein the control device is embodied to vary the off-time in such a way that the following applies:

$$\frac{1}{T_{on}+T_{off}} \neq \frac{1}{2\pi\sqrt{L_Z C_1}}$$

where $T_{on}$ represents the on-time, $T_{off}$ the off-time, $L_Z$ the inductor arranged in series with one of the output terminals, and $C_1$ the capacitance of the first capacitor.

2. The circuit arrangement as claimed in claim 1, wherein the control device is embodied to vary the off-time in proportion to the output voltage.

3. The circuit arrangement as claimed in claim 2, wherein the control device is embodied to shorten the off-time if there is an increase in the output voltage and vice versa.

4. The circuit arrangement as claimed in claim 1, wherein the following applies:

$$\frac{1}{T_{on}+T_{off}} \neq 0.8 \text{ to } 1.2 * \frac{1}{2\pi\sqrt{L_Z C_1}};$$

where $T_{on}$ represents the on-time, $T_{off}$ the off-time, $L_Z$ the inductor arranged in series with one of the output terminals, and $C_1$ the capacitance of the first capacitor.

5. The circuit arrangement as claimed in claim 1, wherein $$\frac{1}{n*(T_{on}+T_{off})} \neq \frac{1}{2\pi\sqrt{L_Z C_1}};$$

where n=1, 2, 3, . . .

where $T_{on}$ represents the on-time, $T_{off}$ the off-time, $L_Z$ the inductor arranged in series with one of the output terminals, and $C_1$ the capacitance of the first capacitor.

6. The circuit arrangement as claimed in claim 5, wherein $$\frac{1}{n*(T_{on}+T_{off})} \neq 0.8 \text{ to } 1.2 * \frac{1}{2\pi\sqrt{L_Z C_1}};$$

where n=1, 2, 3, . . .

where $T_{on}$ represents the on-time, $T_{off}$ the off-time, $L_Z$ the inductor arranged in series with one of the output terminals, and $C_1$ the capacitance of the first capacitor.

7. The circuit arrangement as claimed in claim 1, wherein the detuning of the oscillating circuit consisting of the first capacitor and the inductor as a result of the impedance of the discharge lamp that is to be connected at the output is taken into account in the respective formula.

8. The circuit arrangement as claimed in claim 1, wherein the circuit further comprises a current-measuring resistor which is coupled between the anode of the first diode and the second input terminal for the purpose of measuring the current through the first electronic switch in the conducting state of the first electronic switch, wherein the control device is coupled to the current-measuring resistor and is embodied to vary the on-time for the purpose of regulating the current to a predefinable value.

9. The circuit arrangement as claimed in claim 8, wherein the circuit arrangement further comprises a second, third and fourth electronic switch, wherein the first, second, third and fourth electronic switch constitute a full-bridge, wherein the first junction point represents a first bridge center point, wherein the circuit arrangement further comprises a second diode which is coupled in parallel with the first electronic switch, wherein the second electronic switch is coupled in parallel with the first diode, wherein the third and fourth electronic switch are coupled to each other while forming a second junction point which represents a second bridge center point, wherein the second bridge center point represents the second output terminal, wherein the control device is embodied to drive the first, second, third and fourth electronic switch.

10. The circuit arrangement as claimed in claim 9, wherein the control device is embodied to switch the third electronic switch to conducting and the fourth electronic switch and the first electronic switch to non-conducting in a first phase, to switch the fourth electronic switch to conducting and the third electronic switch and the second electronic switch to non-conducting in a second phase, wherein the first and second phase alternate continuously at a first predefinable frequency lying in particular in the low-frequency range, wherein the control device is additionally embodied to switch the second electronic switch in the first phase and the first electronic switch in the second phase alternately to conducting and to non-conducting at a second predefinable frequency lying in particular in the high-frequency range and in so doing to vary the off-time as a function of the measured output voltage.

11. The circuit arrangement as claimed in claim 1, wherein the circuit arrangement further comprises a second capacitor which is coupled between the first input terminal and the first output terminal.

12. A method for operating a discharge lamp on a circuit arrangement comprising an input having a first input terminal and a second input terminal for connecting a supply voltage; a first electronic switch which has a control electrode, a working electrode and a reference electrode, wherein the working electrode is coupled to the first input terminal; a first diode whose anode is coupled to the second input terminal and whose cathode is coupled to the reference electrode of the first electronic switch while forming a first junction point; a control device which is coupled to the control electrode of the first electronic switch for the purpose of driving the first electronic switch; an output having a first output terminal and a second output terminal for providing an output voltage to the discharge lamp; an inductor which is arranged in series with one of the output terminals; a lamp inductor which is coupled between the first junction point and the first output terminal; and a first capacitor which is coupled between the first output terminal and the anode of the first diode; wherein the control device is embodied to switch the first electronic switch continuously to conducting for an on-time and to non-conducting for an off-time; wherein the control device is embodied to vary the off-time in such a way that the following applies:

$$\frac{1}{T_{on}+T_{off}} \neq \frac{1}{2\pi\sqrt{LC_1}}$$

where $T_{on}$ represents the on-time, $T_{off}$ the off-time, $L_Z$ the inductor arranged in series with one of the output terminals, and $C_1$ the capacitance of the first capacitor;

the method comprising: a) measuring the output voltage; b) coupling a signal which is correlated with the measured output voltage to the control device; and c) by means of the control device: varying the off-time as a function of the measured output voltage.

* * * * *